US006756006B1

(12) United States Patent
Levijoki

(10) Patent No.: US 6,756,006 B1
(45) Date of Patent: Jun. 29, 2004

(54) METHOD OF FORMING SCULPTURED DESIGNS ONTO A SUBSTRATE

(76) Inventor: Peter Levijoki, R. R. 1, Box 1056A, Sylvan Lake (CA), T4S-1X6

( * ) Notice: Subject to any disclaimer, the term of this patent is extended or adjusted under 35 U.S.C. 154(b) by 291 days.

(21) Appl. No.: 10/090,124

(22) Filed: Mar. 5, 2002

(51) Int. Cl.[7] ..... B28B 19/00; B05D 1/28; B05C 1/04

(52) U.S. Cl. ..... 264/259; 264/31; 264/34; 264/316; 264/320; 264/333; 15/104.94; 118/211; 118/212; 427/256

(58) Field of Search ..... 264/259, 316, 264/320, 333, 31, 34; 15/104.94; 118/211, 212; 427/256

(56) References Cited

U.S. PATENT DOCUMENTS

| | | | | | |
|---|---|---|---|---|---|
| D138,249 | S | | 7/1944 | Burton | D5/14 |
| 4,105,816 | A | * | 8/1978 | Hori | 428/159 |
| 4,223,999 | A | * | 9/1980 | Wells | 401/176 |
| 4,257,140 | A | * | 3/1981 | Downing | 15/230.11 |
| 4,271,111 | A | * | 6/1981 | Sheber | 264/71 |
| 5,302,048 | A | | 4/1994 | Paulos et al. | 404/11 |
| 5,320,790 | A | * | 6/1994 | Lowe | 264/31 |
| 5,328,730 | A | * | 7/1994 | Lowe | 428/15 |
| 5,450,672 | A | | 9/1995 | Fortin | 30/293 |
| 5,655,451 | A | * | 8/1997 | Wasylczuk et al. | 101/368 |
| 5,676,999 | A | * | 10/1997 | Silva | 427/140 |
| 5,771,525 | A | * | 6/1998 | Fulcher et al. | 15/244.1 |
| 6,413,336 | B1 | * | 7/2002 | Likness | 156/71 |
| 2003/0104127 | A1 | * | 6/2003 | Katzen et al. | 427/256 |

* cited by examiner

*Primary Examiner*—Michael Colaianni
*Assistant Examiner*—Michael I. Poe
(74) *Attorney, Agent, or Firm*—Donald R. Schoonover

(57) ABSTRACT

A method of forming sculptured designs onto a substrate using a hand tool includes a container that can contain compound that is suitable for placing sculptured designs onto a substrate such as a ceiling or a wall, and an applicator that can move into and out of the container. A pattern on the applicator unit includes pattern elements that are arranged in a selected pattern and have cavities defined therebetween. The cavities are sized to temporarily accommodate compound that is used to define the sculptured design on the substrate and are arranged in a pattern such that the compound will define the desired pattern when the applicator is pressed against the substrate.

2 Claims, 3 Drawing Sheets

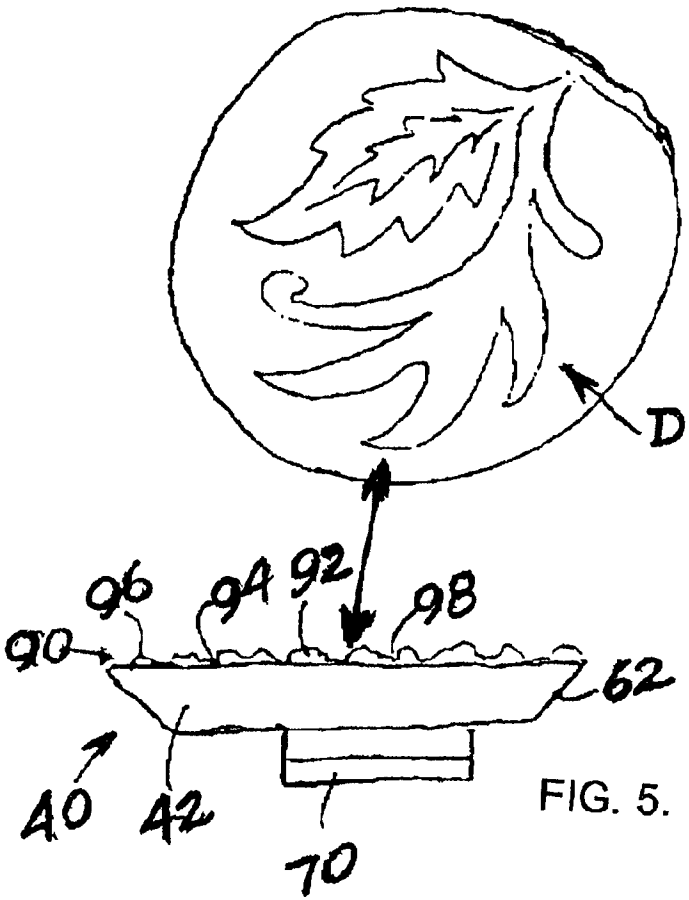
FIG. 6.
FIG. 5.
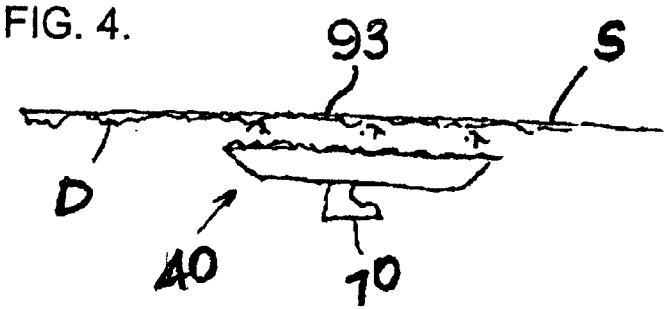
FIG. 4.
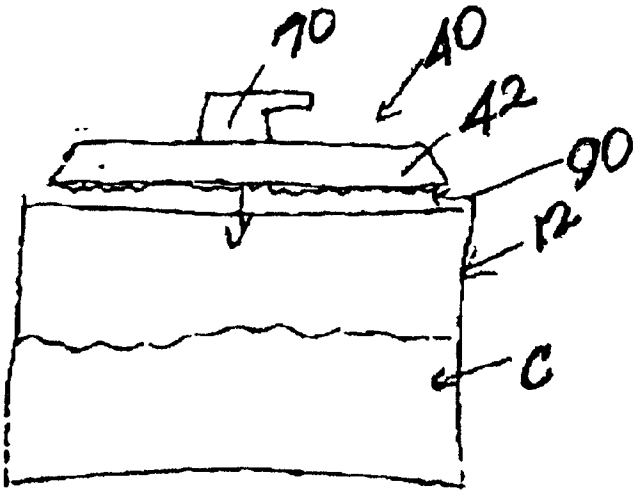
FIG. 3.

METHOD OF FORMING SCULPTURED DESIGNS ONTO A SUBSTRATE

BACKGROUND OF THE INVENTION

1. Field of the Invention

The present invention relates to the general art of hand tools, and to the particular field of hand tools used for applying coatings to substrates.

2. Discussion of the Related Art

Finish work for a building often includes placing drywall and drywall compounds onto substrate elements, such as ceilings and/or walls of the building. This process is generally carried out by brushing or troweling drywall compound onto the chosen substrates.

The inventor has found that many people wish to vary the appearance of the walls and/or ceilings of their homes, offices or other buildings. Obviously, this can be achieved using various wall hangings such as pictures and the like. However, many people want more variety than such traditional elements can provide.

This additional variety can be achieved by applying designs to the walls and/or ceilings. Such designs can be effected using special moldings; however, this can be costly in both time and materials.

Another method of applying designs to walls and/or ceilings has included the use of templates. A template is placed on the wall or ceiling and paint applied. A design results. Yet another method of applying designs to a wall or ceiling has included the use of patterned paint rollers. Applying paint to a surface using a patterned paint roller is effective in applying a repeating pattern to a substrate, While effective, the just-described methods of applying decorations to a wall or ceiling are merely two dimensional and thus the decorations are not truly unique and could be considered as mere variations of pictures and other wall hangings.

Therefore, there is a need for a means and method of applying decorations to a substrate that produce a unique decoration.

The inventor has found that sculptured decorations, that is decorations that stand out from a substrate, are quite popular. However, in the past, such sculptured decorations have required special tools and special processes and may require the services of a highly skilled specialist. These requirements can make such sculptured decorations expensive and also increase the time it takes to complete a job.

Therefore, there is a need for a means and method of applying sculptured decorations to a substrate.

Still further, there is a need for a means and method of applying sculptured decorations to a substrate in an efficient and cost-effective manner.

To be most unique, it is desirable that the sculptured decorations be varied and easily variable. A wide variety of patterns on either the ceilings or walls or both can add special uniqueness to any room. Furthermore, such patterns can be used to add or enhance a special style for a room. For example, a Victorian look for a room can be enhanced by special Victorian sculptures on the walls and/or on the ceiling of the room. Other styles include traditional, modern, old fashioned, contemporary, and the like. The styles are only limited by the imaginations and budget of the client and the decorator.

However, because such decorations are difficult and time consuming to produce, it can be costly to achieve a high degree of uniqueness.

Therefore, there is a need for a means and method of applying sculptured decorations to a substrate which can efficiently and in a cost effective manner produce a wide variety of designs.

Still further, once applied, many surface decorations which have been formed using presently-available means and methods may be degraded by washing. This is a significant drawback because room walls and ceilings must be washed from time to time. If the washing degrades the surface decorations, after some time these decorations will become something that the building owner did not purchase.

Therefore, there is a need for a means and method of applying sculptured decorations to a substrate that can be washed without significant degradation.

Still further, there are occasions when it is desirable to have a wide variety of different surface decorations on the same substrate in order to achieve a particular effect. However, if it is costly to execute such decorations, such variety cannot be achieved without significant expense and time.

Therefore, there is a need for a means and method of applying sculptured decorations to a substrate in which a wide variety of decorations can be applied to a single substrate in an efficient and cost-effective manner.

While some sculpturing can be achieved using special brushes and trowels that, for example, have serrated edges, these means and methods cannot achieve a wide variety of designs, some of which do not include lines and curves associated with such edges and brushes.

Therefore, there is a need for a means and method of applying sculptured decorations to a substrate that can achieve designs that vary from lines and curves associated with brushes and serrated edges.

PRINCIPAL OBJECTS OF THE INVENTION

It is a main object of the present invention to provide a means and method of applying decorations to a substrate that produce a unique decoration.

It is another object of the present invention to provide a means and method of applying sculptured decorations to a substrate.

It is another object of the present invention to provide a means and method of applying sculptured decorations to a substrate in an efficient and cost-effective manner.

It is another object of the present invention to provide a means and method of applying sculptured decorations to a substrate which can efficiently and in a cost effective manner produce a wide variety of designs.

It is another object of the present invention to provide a means and method of applying sculptured decorations to a substrate that can be washed without significant degradation.

It is another object of the present invention to provide a means and method of applying sculptured decorations to a substrate in which a wide variety of decorations can be applied to a single substrate in an efficient and cost-effective manner.

It is another object of the present invention to provide a means and method of applying sculptured decorations to a substrate that can achieve designs that vary from lines and curves associated with brushes and serrated edges.

SUMMARY OF THE INVENTION

These, and other, objects are achieved by a hand tool for decorating a substrate comprising an open top container unit; an applicator unit which is sized relative to said container unit to be received in said container unit; a handle on said applicator unit; and a relief pattern on one surface of said applicator unit having a substrate-contacting surface which is spaced from the one surface of said applicator unit and a multiplicity of compound-receiving cavities.

The hand tool is used by placing compound that will be used to form the sculptured decorations on the substrate in the container unit and then forcing the applicator unit into the container unit and into contact with the compound until some of the compound fills the cavities in the applicator unit relief pattern unit. Then, the applicator unit is withdrawn from the container unit and applied against the substrate and the relief pattern is compressed so the compound in the cavities is applied to the substrate. Some of the compound will adhere to the substrate and the applicator unit is removed from the substrate. The compound that remains will form a pattern that corresponds to the pattern on the applicator unit and will define the sculptured decoration on the substrate.

By changing applicator units, various sculptured decorations can be formed. Since it is quite easy to change applicator units, a great variety of different sculptured decorations can be formed in an easy and efficient manner. The compound can be any suitable compound, including drywall-type compound and thus will be very durable once applied. Even unskilled workers can apply the decorations due to the ease with which the hand tool is used and no special tools or skill is required to use the hand tool.

BRIEF DESCRIPTION OF THE DRAWINGS

FIG. 3 is a side elevational view showing the tool embodying the teaching of the present invention with compound in the container unit as an illustration of the use of the tool of the present invention to carry out the method embodying the present invention.

FIG. 4 is an elevational view showing another step in the method of the present invention.

FIG. 5 is an elevational view showing another step in the method of the present invention.

FIG. 6 is a plan view showing a sculptured decoration on a substrate that results from the method and means of the present invention.

DETAILED DESCRIPTION OF THE INVENTION

Other objects, features and advantages of the invention will become apparent from a consideration of the following detailed description and the accompanying drawings.

The means and method of the present invention permits a wide variety of sculptured decorations to be placed on a substrate, such as a wall or a ceiling, in a timely and efficient manner. Compound, such as drywall-type compound, is stored in an easily carried container and an applicator is simply pressed into the compound in the container to pick up compound in a patterned manner and then pressed against the substrate to deposit the compound onto the substrate in the manner that corresponds to the pattern. A wide variety of applicators can be used to effect a wide variety of decorations, even on the same substrate. Since the method and means are so simple, it is quite easy for even an unskilled worker to effect complicated and unique designs on the walls and/or ceilings of a building. Since the compound can be any suitable material, it can be quite durable, even if washed a number of times.

Figures 1, 2:
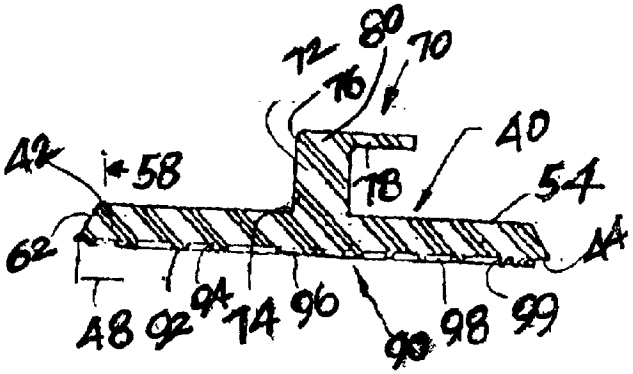
FIG. 1 is a top perspective view of a container unit and an applicator unit included in the tool embodying the teaching of the present invention.
FIG. 2 is a side view taken along line 2—2 of FIG. 1.
Figure 7:
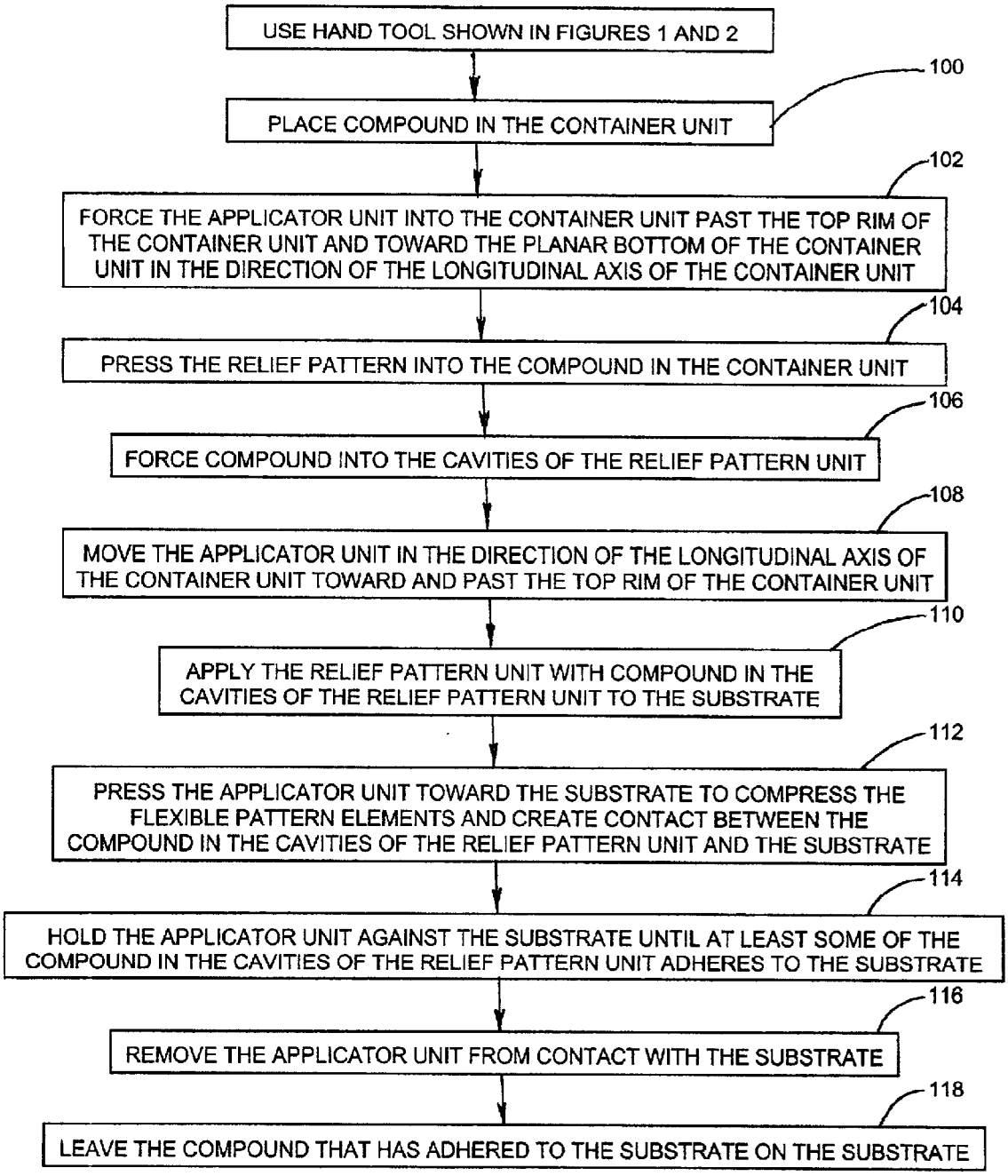
FIG. 7 is a flow chart showing the method embodying the teaching of the present invention.

Referring to FIGS. 1–3, it can be seen that the means of the present invention is embodied in a hand tool 10 for decorating a substrate S (see FIG. 4) such as a ceiling or a wall or other such element of a building. Hand tool 10 comprises a container unit 12 having a planar bottom 14 having a circular perimeter 16, a circular sidewall 18 which has an inside surface 20 and an outside surface 22. Circular sidewall 18 is attached to planar bottom 14 and extends from planar bottom 14. A top rim 24 is located on sidewall 18 to be spaced from planar bottom 14 and is circular and has an inside diameter indicated at reference number 26. A longitudinal axis 28 of the container unit 12 extends from bottom 14 to top rim 24.

Container unit 12 further includes handles 30 and 32 on outside surface 22 of sidewall 18 and are diametrically spaced apart from each other.

Hand tool 10 further includes an applicator unit 40 best shown in FIGS. 1 and 2. Applicator unit 40 includes a body 42 which can be plastic or any other suitable material that is easily cleaned. Body 42 includes a bottom surface 44 having an oval shaped outer perimeter 46 with a major dimension indicated by reference number 48 and a minor dimension indicated by reference number 50. Major dimension 48 is larger than minor dimension 50 and is smaller than inside diameter 26 of top rim 24 of sidewall 18 of container unit 12. Applicator unit 40 further includes a planar top surface 54 which has an oval shaped outer perimeter 56 having a major dimension indicated by reference number 58 and a minor dimension indicated by reference number 60. Major dimension 58 of top surface 54 of body 42 of applicator unit 40 is larger than minor dimension 60 of top surface 54 of body 42 of applicator unit 40 and is smaller than major dimension 48 of bottom surface 44 of body 42 of applicator unit 40 and minor dimension 60 of top surface 54 of body 42 of applicator unit 40 is smaller than minor dimension 50 of bottom surface 44 of body 42 of applicator unit 40. A conical sidewall 62 connects bottom surface 44 of body 42 of applicator unit 40 to top surface 54 of body 42 of applicator unit 40.

The size of the body of the applicator unit 40 relative to the size of the container unit 12 permits the applicator unit 40 to be moved into and out of the container unit 12 in the direction of longitudinal axis 28 for a purpose that will be understood from the teaching of this disclosure.

Hand tool 10 further includes an L-shaped handle 70 on top surface 54 of body 42 of applicator unit 40. Handle 70 includes a first leg 72 with a proximal end 74 on top surface 54 of body 42 of applicator unit 40 and a distal end 76 spaced apart from top surface 54. Handle 70 further includes a second leg 78 having one end 80 on distal end 76 of the first leg 72 of the L-shaped handle 70 and extends parallel to planar top surface 54 of body 42 of applicator unit 40.

Hand tool 10 further includes a relief pattern unit 90 on bottom surface 44 of body 42 of applicator unit 40. As shown in FIG. 2, relief pattern unit 90 includes a multiplicity of flexible pattern elements, such as pattern element 92, which are spaced apart from each other, with each pattern element 92 having a base 94 attached to bottom surface 44 and an end surface 96 spaced apart from bottom surface 44 of body 42. A multiplicity of open-ended cavities, such as cavity 98, are each defined between adjacent pattern elements and are defined by adjacent pattern elements 92 and bottom surface 44 of body 42 of applicator unit 40. Cavities 98 are sized to temporarily hold compound therein after pattern unit 90 of the applicator unit 40 has been forced into the compound and then to release that temporarily-held compound when the pattern unit 90 is pressed against a substrate, such as ceiling 93 for example, in the manner of a hand stamp, such as an ink stamp or the like.

Each pattern element 92 has an outside surface 99 which extends between bottom surface 44 and end 96 which is shaped to define a negative image of a desired pattern to be defined on a substrate. The shape of each open-ended cavity is defined by the shapes of those pattern elements defining the open-ended cavity, and the shape of each open-ended cavity is selected to be identical to a portion of the desired pattern.

Flexible pattern elements 92 are compressible toward bottom surface 44 of body 42 in the manner of such a hand stamp. Thus, when compound is contained in the open-ended cavities, it will have the shape of the desired design and will develop that design when pressed against the substrate in the manner of a hand stamp as will be understood by those skilled in the art based on the teaching of this disclosure.

In some embodiments, such as shown in FIG. 2, end surfaces 96 of pattern elements 92 of relief pattern unit 90 are co-planar with each other. One form of the compound includes a drywall-type compound known to those skilled in the drywall art.

Referring to FIGS. 3–7, the method embodying the present invention will be described. The method uses the hand tool 10 described above with regard to FIGS. 1 and 2 and comprises placing compound C in the container unit 12 in step 100; forcing the applicator unit 40 into the container unit 12 past the top rim 24 of the container unit 12 and toward the planar bottom 14 of the container unit 12 in the direction of the longitudinal axis 28 of the container unit 12 in step 102; pressing the relief pattern into the compound in the container unit 12 in step 104; forcing compound into the cavities of the relief pattern unit in step 106; moving the applicator unit 40 in the direction of the longitudinal axis 28 of the container unit 12 towards and past the top rim 24 of the container unit 12 in step 108; applying the relief pattern unit with compound in the cavities of the relief pattern unit to a substrate in step 110 and as indicated in FIG. 4; pressing the applicator unit 40 toward the substrate to compress the flexible pattern elements and creating contact between the compound in the cavities of the relief pattern unit and the substrate in step 112; holding the applicator unit 40 against the substrate until at least some of the compound in the cavities of the relief pattern unit adheres to the substrate in step 114; removing the applicator unit 40 from contact with the substrate in step 116; and leaving the compound that has adhered to the substrate on the substrate in step 118 and as indicated in sculptured decoration D in FIG. 6.

It is understood that while certain forms of the present invention have been illustrated and described herein, it is not to be limited to the specific forms or arrangements of parts described and shown.

I claim:

1. A method of decorating a substrate comprising:

a) providing a hand tool for decorating a substrate comprising a container unit having a planar bottom having a circular perimeter, a circular sidewall, the sidewall having an inside surface and an outside surface, the circular sidewall being attached to the planar bottom and extending from the planar bottom, a top rim on the sidewall spaced from the planar bottom, the top rim being circular and having an inside diameter, a longitudinal axis extending from the bottom to the top rim, and a handle on the outside surface of the sidewall; an applicator unit having a body having a bottom surface having an oval-shaped outer perimeter with a major dimension and a minor dimension with the major dimension being larger than the minor dimension and smaller than the inside diameter of the top rim of the sidewall of said container unit, a planar top surface having an oval-shaped outer surface having a major dimension and a minor dimension with the major dimension of the top surface of the body of said applicator unit being larger than the minor dimension of the top surface of the body of said applicator unit and smaller than the major dimension of the bottom surface of the body of said applicator unit and the minor dimension of the top surface of the body of said applicator unit being smaller than the minor dimension of the bottom surface of the body of said applicator unit, and a conical sidewall connecting the bottom surface of the body of said applicator unit to the top surface of the body of said applicator unit, an L-shaped handle on the top surface of the body of said applicator unit and having a first leg with a proximal end on the top surface of the body of said applicator unit and a distal end spaced apart from the top surface of the body of said applicator unit, a second leg having one end on the distal end of the first leg of the L-shaped handle and extending parallel to the planar top surface of the body of said applicator unit; and a relief pattern unit on the bottom surface of the body of said applicator unit, the relief pattern unit including a multiplicity of flexible pattern elements which are spaced apart from each other, each pattern element of the multiplicity of flexible pattern elements having a base attached to the bottom surface of the body of said applicator unit and an end surface spaced apart from the bottom surface of the body of said applicator unit, a multiplicity of open-ended cavities each defined between adjacent pattern elements and defined by adjacent pattern elements and the bottom surface of the body of said applicator unit, and the flexible pattern elements being compressible toward the bottom surface of the body of said applicator unit;

b) placing compound in the container unit;

c) forcing the applicator unit into the container unit past the top rim of the container unit and toward the planar bottom of the container unit in the direction of the longitudinal axis of the container unit;

d) pressing the relief pattern into the compound in the container unit;

e) forcing compound into the cavities of the relief pattern unit;

f) moving the applicator unit in the direction of the longitudinal axis of the container unit towards and past the top rim of the container unit;

g) applying the relief pattern unit with compound in the cavities of the relief pattern unit to a substrate;

h) pressing the applicator unit toward the substrate to compress the flexible pattern elements and creating contact between the compound in the cavities of the relief pattern unit and the substrate;

i) holding the applicator unit against the substrate until at least some of the compound in the cavities of the relief pattern unit adheres to the substrate;

j) removing the applicator unit from contact with the substrate; and k) leaving the compound that has adhered to the substrate on the substrate.

2. The method as described in claim 1 wherein the compound includes drywall-type compound.

* * * * *